United States Patent [19]

Sirois

[11] Patent Number: 4,854,903

[45] Date of Patent: Aug. 8, 1989

[54] PARALLEL THRUST PROPULSION SYSTEM

[75] Inventor: William L. Sirois, Miami, Fla.

[73] Assignee: Copeland-Sirois Enterprises, Inc., Jefferson, La.

[21] Appl. No.: 134,145

[22] Filed: Dec. 17, 1987

[51] Int. Cl.[4] ..... B63H 23/02

[52] U.S. Cl. ..... 440/83; 440/79

[58] Field of Search ..... 440/83, 66, 82, 79, 440/68, 49, 61; 114/291; 464/183

[56] References Cited

U.S. PATENT DOCUMENTS

| | | | |
|---|---|---|---|
| 4,127,080 | 11/1978 | Lakiza et al. | 440/83 |
| 4,128,072 | 12/1978 | Wood, Jr. | 114/291 |
| 4,544,362 | 10/1985 | Arneson | 440/61 |
| 4,565,532 | 1/1986 | Connor | 440/61 |

FOREIGN PATENT DOCUMENTS

| | | | |
|---|---|---|---|
| 1032427 | 6/1966 | United Kingdom | 440/83 |
| 2028746 | 3/1980 | United Kingdom | 440/79 |

*Primary Examiner*—Joseph F. Peters, Jr.
*Assistant Examiner*—Edwin L. Swinehart
*Attorney, Agent, or Firm*—Larson and Taylor

[57] ABSTRACT

A marine propulsion system for high performance power boats is provided which includes a propellor shaft that extends parallel to the surface and thus enables a "surfacing" operation wherein each of the propellor blades or discs extend out of the water during a portion of the rotational period thereof. The system includes a universal joint which joins the propellor shaft to an inclined connecting member connected to a reduction gear unit. The universal joint is located in an upper support housing mounted to the underside of a recessed area at the stern of the hull while the propellor shaft is mounted by a thrust bearing assembly and a further, spaced bearing assembly within a lower support housing affixed to the upper housing. The propellor assembly includes a thrust sleeve joined to the propellor shaft by a series of spaced weldments which serve in transmitting thrust to the sleeve.

22 Claims, 6 Drawing Sheets

PARALLEL THRUST PROPULSION SYSTEM

FIELD OF THE INVENTION

The present invention relates to propulsion systems particularly adapted for, but not limited to, high performance racing boats and more particularly to an improved propulsion system which, among other applications, enables a "surfacing" operation wherein only a portion of the drive propellor is in the water.

BACKGROUND OF THE INVENTION

Many different propulsion systems are used for boats of various kinds for various purposes. Some prior art systems of possible interest with respect to the invention include those disclosed in U.S. Pat. Nos. 2,521,368 (Hingerty Jr.); 3,070,061 (Rightmyer); 3,105,455 (Baldwin); 3,744,446 (Gibbins); 3,793,980 (Sherman); 3,924,557 (Bloch); 3,938,463 (Hecker et al); 3,942,466 (Bunyon); 4,293,304 (Sandstrom); 4,363,630 (Di Vigano); and 4,544,362 (Arneson).

As mentioned above, one aspect of the invention concerns the provision of a propulsion system which enables a "surfacing" operation in a high performance power boat, i.e., a mode of operation wherein the propellor, rather than being fully submerged in the water as is the case with a conventional propellor, is positioned such that the centerline of the shaft is located approximately at the level of the water. Thus, the propellor operates with a portion of the effective disc or blade area thereof in the water and the remainder in the air. A discussion of propulsion systems of this general type is contained in the Sherman patent referred to above which disclosees a marine propulsion system of the "surface propellor" type. In that system the propellor shaft is inclined at an angle and is disposed within a tunnel or channel formed in the hull. The propellor shaft is supported in the tunnel by a combined bearing and stuffing box disposed within the hull and a further bearing supported in the tunnel by a strut located just ahead of the propellor. The Gibbins patent discloses a similar arrangement in a propellor driven planing boat wherein the propellor shaft is mounted within a specially shaped channel in the hull and is mounted between external spaced bearings, located adjacent the hull and astern of the propellor, respectively, so that the propellor shaft extends generally parallel to the surface of the water.

Briefly considering some of the other patents referred above, The Sandstrom patent discloses a flexibly mounted drive arrangement for a ship including a pair of universal joints connecting a propellor shaft to a reduction gear unit, the shaft being supported in a flexibly mounted thrust bearing, and a second set of universal joints serving to connect the gear unit to the engine. The Hingerty Jr. patent discloses a marine thrust bearing assembly, including a pair of oppositely effective bearings, connected to a conventional, inclined propellor shaft. The other patents disclose further propulsion systems of general interest.

SUMMARY OF THE INVENTION

In accordance with the present invention, a parallel thrust propulsion system particularly adapted for but not limited to high performance power boats is provided which, among other advantages, enables high speed "surfacing" operation as discussed above, while overcoming the disadvantages of the prior art. In addition to high performance applications, the propulsion system of the invention, which has no undershaft protrusions, is also particularly adapted for shallow water use because of the low profile of boats incorporating the system. The parallel thrust system of the invention enables a boat construction of low drag coefficient, which, among other advantages, is more efficient in shallow water applications.

In accordance with the invention, a propulsion system for a high speed power boat is provided which includes a drive motor including an output drive shaft; a fixed propellor shaft having a propellor mounted thereon; intermediate drive means for interconnecting the output drive shaft of the drive motor and the propellor shaft; and means for mounting the fixed propellor shaft so that the shaft extends parallel to the surface of the water and such that a substantial portion of the effective blade or disc area of the propellor is out of the water under normal operating conditions, thereby providing zero degree, i.e., parallel, thrust operation. The drive means includes a connecting member arranged at an angle with respect to the propellor shaft and a universal joint disposed between one end of the connecting member and the propellor shaft, and the mounting means including a propellor shaft support housing located externally of the hull of the boat, a thrust bearing assembly disposed within the external housing at the end of the propellor shaft connected to the universal joint, and a further bearing assembly disposed within the external housing at the other end of the propellor shaft.

Preferably, an upper support housing is located externally of the hull. The propellor shaft support housing is supported by the upper support housing and the universal joint is located in the upper support housing.

Advantageously, the propellor shaft support housing includes a longitudinal bore therein and the thrust bearing assembly includes a pair of oppositely acting thrust bearing devices mounted within an enlarged portion of that bore. The propellor shaft support housing also preferably includes a preloading thrust member against which one of the thrust bearing devices acts, and a means for holding the thrust member in place in the enlarged portion of the bore. Further, a sealing means is provided for effecting sealing between the thrust member and the propellor shaft so as to seal off the end of the bore adjacent to the universal joint.

Advantageously, the further bearing assembly comprises a roller bearing assembly. This roller bearing assembly is preferably disposed in a further enlarged portion of the bore and the propellor shaft support housing further includes additional sealing means for sealing off the further enlarged end of the bore. Preferably, this additional sealing means includes a cylindrical seal carrier and at least one peripheral sealing ring carried by the seal carrier. In an advantageous embodiment, the further sealing means also includes at least one lip seal disposed between the seal carrier and the propellor shaft.

In a preferred embodiment, the drive means further includes a reduction gear unit; means, comprising a pair of universal joints, for interconnecting the motor drive shaft and an input of the reduction gear unit; and a further universal joint for connecting an output of the reduction gear unit to the other end of the connecting member mentioned above.

In accordance with a further important embodiment of the invention, a sleeve member is provided which surrounds the propellor shaft over a substantial portion of the length thereof, and a plurality of weldments are provided at spaced locations along the sleeve which join the sleeve to the propellor shaft and through which thrust is transmitted from the propellor shaft to the sleeve.

In an alternate, advantageous embodiment, the connection between the propellor shaft and thrust sleeve is eliminated and an annular thrust member is provided in contact with the hub of the propellor, and with the further bearing assembly, so as to provide a thrust avenue between the propellor and the thrust sleeve. This eliminates the undercut typically provided on the propellor shaft in the thrust sleeve embodiment described above. Such undercut is used to enable the propellor shaft to thrust against the bearing but has the disadvantage of weakening the shaft.

Other features and advantages of the invention will be set forth in, or apparent from, the detailed description of preferred embodiments of the invention which follows.

DESCRIPTION OF A PREFERRED EMBODIMENT

Figure 1:
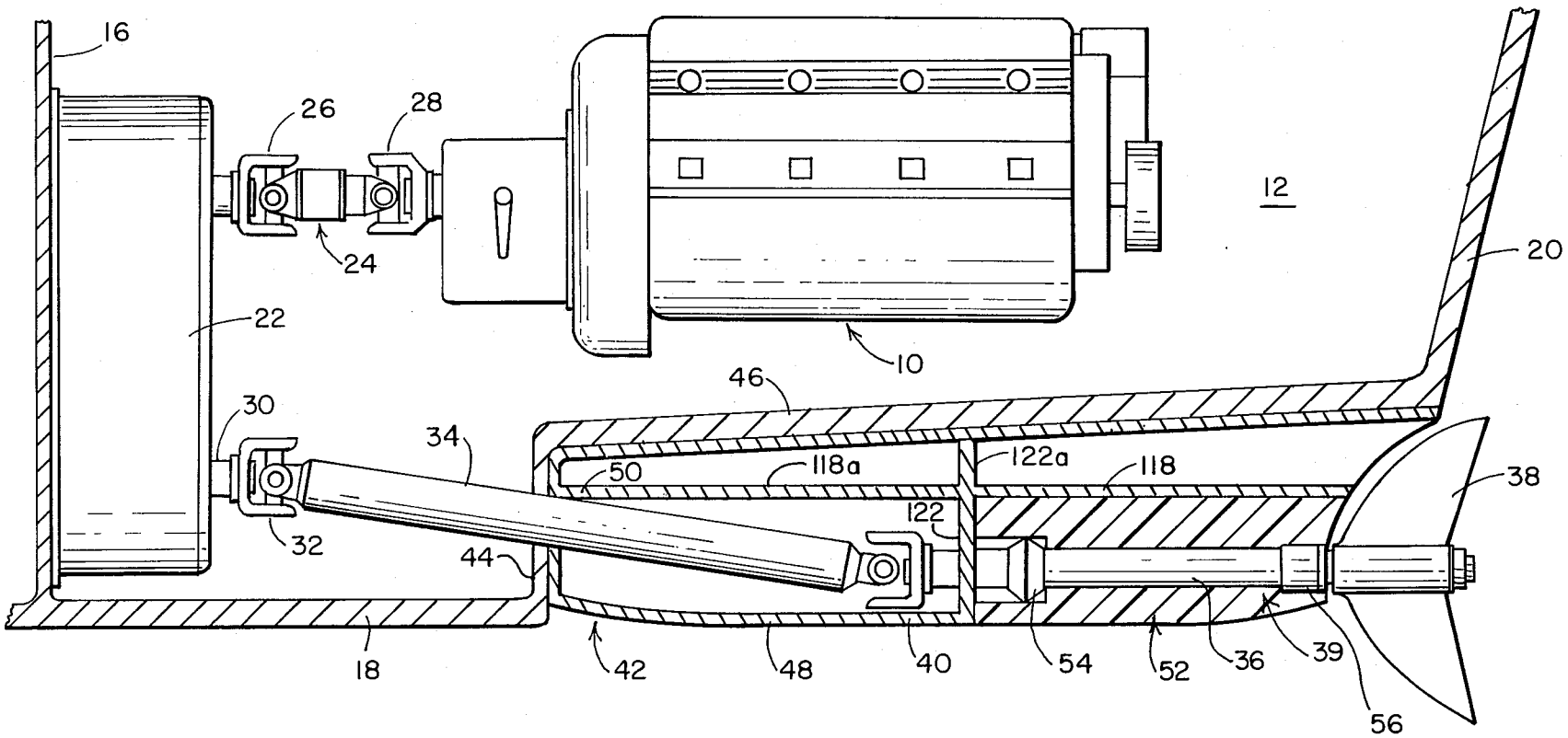
FIG. 1 is a schematic side elevational view, partially in cross section and partially broken away, of a power boat incorporating the propulsion system of the present invention.

Referring to FIG. 1, the basic units of the parallel thrust propellor drive system of the invention are shown in a schematic manner. These units include a drive motor or engine 10 located in an engine compartment 12 of a power boat generally denoted 14. The portion of the engine compartment 12 which is shown in FIG. 1 is defined by a front wall 16, the boat hull 18 and the rear wall or transom 20 of the boat 14. The engine compartment 12 also houses a reduction gear unit 22 which is connected to motor 10 through a coupling 24 formed by a pair of universal joints 26 and 28. Reduction gear unit 22 includes an output shaft 30 coupled by a universal joint 32 to a connecting strut or connecting member 34 which is, in turn, connected to a propellor drive assembly 39 through a further universal joint 40. It will be understood that shaft 34 can be directly connected to engine 10 and that, for example, the various connecting joints, can take a number of different forms.

As illustrated in FIG. 1, the stern of the hull 18 is stepped to provide a recessed area 42 defined by a vertically inwardly extending transverse wall 44 and rearwardly extending wall 46 which extends generally parallel to main portion of hull 18. The recessed area 42 accommodates an upper drive support housing 48 in which universal joint 40 is housed and connecting member 34 extends through wall 44 and a corresponding opening 50 in support housing 48 at angle with respect to the longitudinal axis of the boat to permit the propellor shaft 36 to extend generally parallel to the water. The upper drive support housing 48 is described in more detail hereinbelow in connection with FIGS. 7 to 12.

Drive support housing 48 supports a lower drive support housing 52 in which the propellor shaft 36 is mounted for rotation. More particularly, as discussed below, propellor shaft 36 is mounted in lower drive housing 52 by a thrust bearing assembly indicated at 54 and longitudinally spaced roller bearing assembly indicated at 56. Lower drive housing 52 and the mounting assembly for propellor shaft 36 are described in more detail below in FIGS. 2A to 6.

Figure 13:
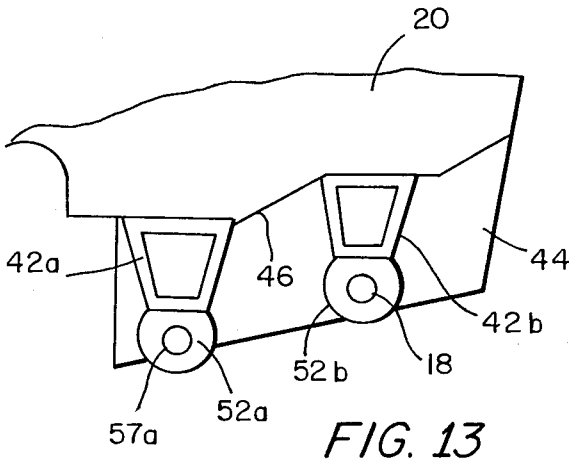
FIG. 13 is a diagrammatic end view of a power boat incorporating a pair of propellor support housings in accordance with the invention.
Figure 12:
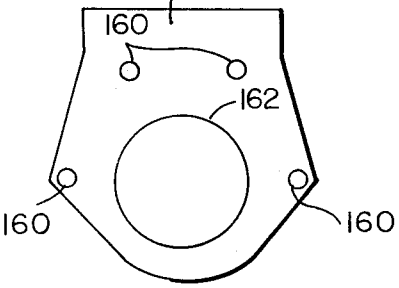
FIG. 12 is a rear elevational view of an end plate shown in FIG. 11.

Before considering FIGS. 2A to 6 and FIGS. 7 to 12, reference is made to FIG. 13 which is a diagrammatic end view of the stern of a catamaran type power boat incorporating four drive propellor support assemblies, two of which are shown. The two support assemblies, which are located in the recessed area 42 at the stern of the boat provided by the stepped or porch-like hull 44, 46 (illustrated in FIG. 1) comprise upper and lower support housings **42*a* and 52*a*, and upper and lower support housings 42*b* and 52*b***, respectively.

Figures 2A, 2B:
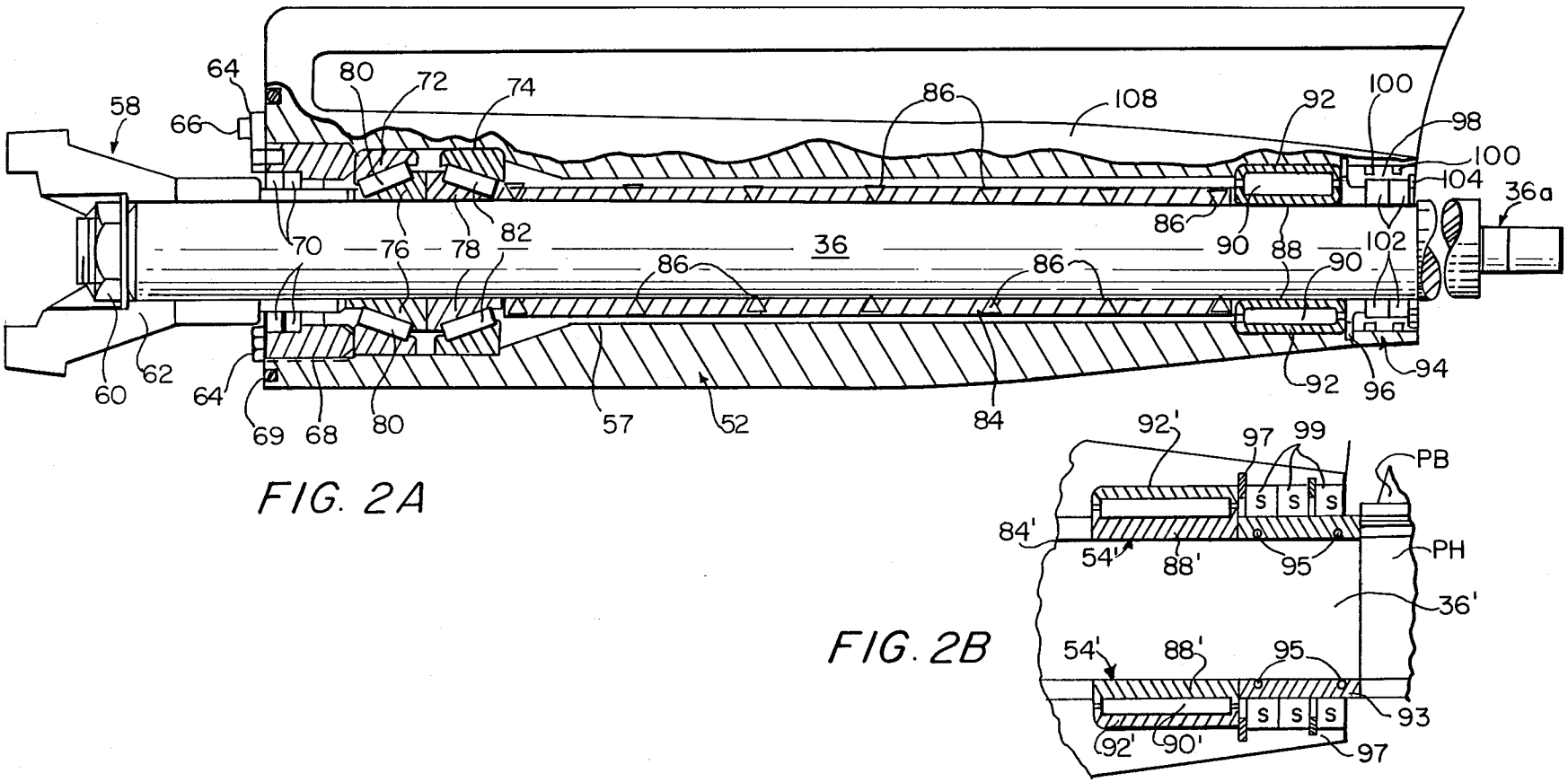
FIG. 2A is a side elevational view, partially in cross section and partially broken away, of a first embodiment of a propellor drive shaft assembly and support housing therefor.
FIG. 2B is a side elevational view, partially in cross section, and partially broken away, of the propellor end of a second embodiment of the propellor drive assembly and support housing.

Referring to FIG. 2A, the mounting arrangement for the propellor drive assembly 39 is shown in more detail. As illustrated, propellor drive shaft 36 is disposed in a shaped base 57 in housing 52. Shaft 36 is connected to a yoke member 58, which is adapted to be connected to universal joint 40 of FIG. 1, by a propellor shaft nut 60 and associated washer 62. Housing 52 further includes a retaining ring 64, bolted thereto by hold-down bolts 66, which retains a preloading thrust nut 68 in place, as shown. An O-ring seal 69 is mounted in the front wall of housing 52 in surrounding relation to retaining ring 64. A pair of lip seals 70 are disposed between widened portion of shaft 36 and a recess in nut 68.

Thrust nut 68 bears against the outer race 72 of thrust bearing assembly 54. As illustrated, thrust bearing assembly 54 includes a pair of oppositely inclined outer races 72 and 74 engaged with the walls of housing 52 which define bore 57 and a corresponding pair of inner races 76 and 78 engaged with shaft 36, with thrust bearings 80 and 82 respectively disposed between associated pairs of inner and outer races as illustrated. Stated differently, bearings 80 are part of a forward thrust bearing assembly including races 72 and 76 and bearings 82 are part of rear bearing assembly including races 74 and 78.

A thrust tube or sleeve 84 is mounted on and surrounds shaft 36 in abutting relation with inner race 78 and a plurality of weldments, indicated at 86, are provided along tube 84 which secure thrust tube 84 to shaft 36 and serve to transmit thrust transmitted along shaft 36 t thrust tube 84. As illustrated, thrust tube 84 extends along shaft 84 over a large portion of the length thereof.

Roller bearing assembly 56, which was referred to above, is mounted on shaft 36 in spaced relation to thrust tube 84 and includes an inner race 88 in engagement with shaft 36, roller bearings 90 and an outer race 92 in engagement with the walls of bore 57 in housing 52.

A mounting and sealing assembly 94 is located at the rear or stern end of bore 57 and includes a retainer snap ring 96, a cylindrical seal carrier member 98, a pair of circumferential O-ring seals 100 disposed in carrier 98 in engagement with the walls of bore 57, a pair of lip seals 102 corresponding to seals 70 at the other end of bore 57, and a further snap ring retainer 104. The free end **36*a* of shaft 36 is, of course, connected to the drive propellor (indicated at 38 in FIG. 1**), the propellor having been omitted in FIG. 2A for purposes of simplicity.

Figure 3:
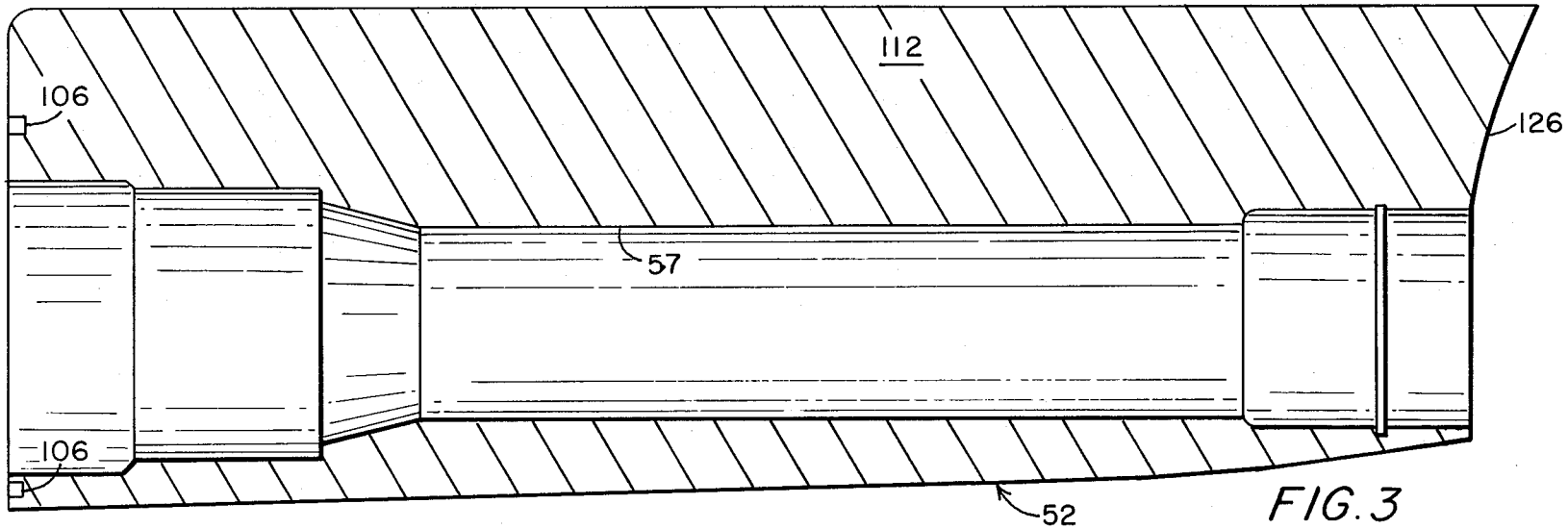
FIG. 3 is a longitudinal cross section of the support housing of FIG. 2A.

The overall construction of housing 52 can be perhaps best understood from a consideration of FIGS. 3 to 6. FIG. 3 is a cross section similar to what is shown in the broken away portion of FIG. 2A, showing the shape of longitudinal bore 57 as well as a circular groove 106 (FIG. 2A) in which O-ring 69 is received. The sides of groove 69 are preferably canted for inclined at an angle of about 5°.

Figure 4:
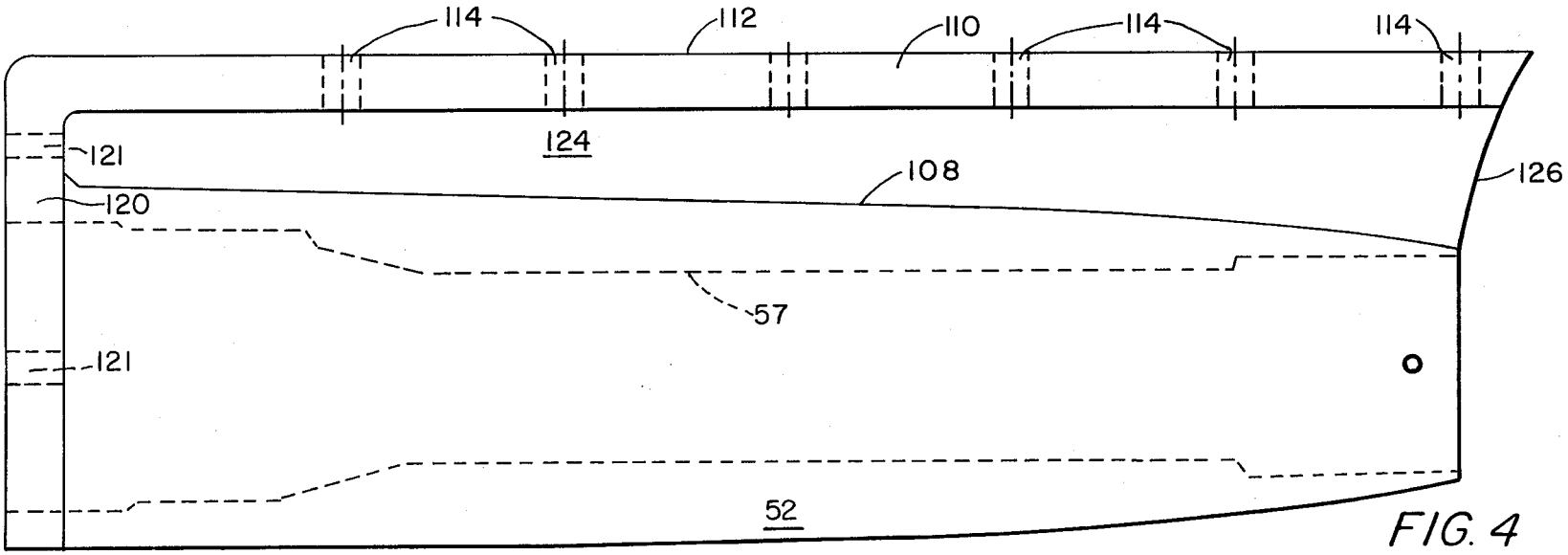
FIG. 4 is a side elevational view of the support housing of FIG. 3.
Figure 6:
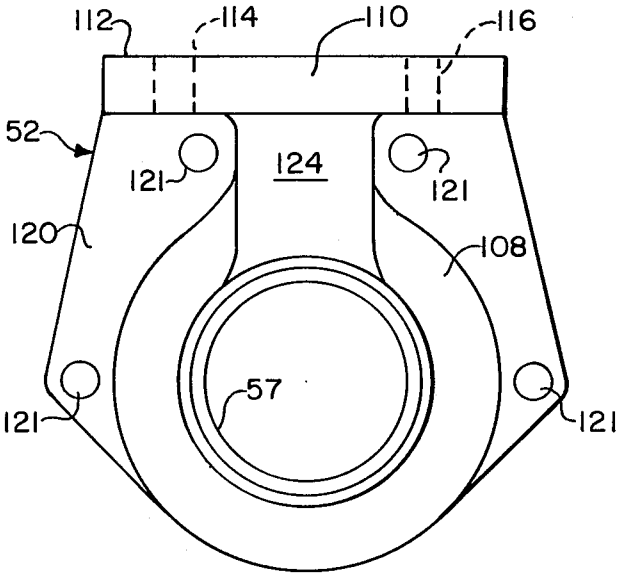
FIG. 6 is a rear end elevational view of the support housing of FIG. 3.
Figure 5:
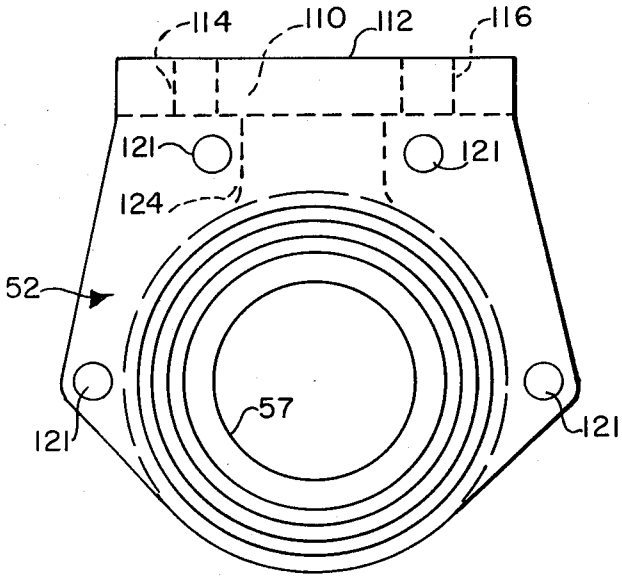
FIG. 5 is a front end elevational view of the support housing of FIG. 3.

As is evident from FIGS. 4 to 6, bore 57 is formed in a bore tube portion 108 which is tapered from the front end to the rear end. Housing 52 further includes an upper support wall or portion 110 having a flat upper surface 112 including two rows of bolt holes, indicated at 114 (FIGS. 4, 5 and 6) and 116 (FIGS. 5 and 6), drilled therein so as to permit bolting of housing 52 to the bottom surface of the horizontally rearwardly extending lower wall (denoted 118 in FIG. 1) of upper housing 48. A front end wall 120, formed integrally with upper wall 110 and with bore tube 108, also includes bolt holes 121 for securing housing 52 to the vertically extending lower rear wall 122 (FIG. 1) of housing 48. The bore tube portion 108 of housing 52 is connected to the lower surface of upper wall 110 by a central support section 124. The rear surface 126 of support 124 and upper wall 120 is gently curved inwardly as shown in FIGS. 3 and 4.

Referring to FIG. 28, an alternate embodiment of the propellor support housing is shown. This embodiment is basically similar to that of FIG. 2A and like elements have been given the same reference numerals with primes attached. This embodiment differs from that of FIG. 2A in that the weldments of FIG. 2A are eliminated and a thrust member 93 is disposed in engagement with a propellor hub PH of which supports propellor blades PB. Thrust member 93 also engages bearing assembly 54' and thus serves as an avenue for transmitting thrust bewtween he propellor hub PH and thrust tube or sleeve 84'. The embodiment of FIG. 2B also includes O-ring seals 95 which seal shaft 36' and a further sealing assembly formed by serially disposed lip seals 99 and retaining rings 97. This embodiment eliminates transmission of thrust through the shaft 36' so that an undercut typically provided on shaft 36' to provide thrusting against the bearing assembly is eliminated. It will be appreciated that such an undercut weakens the shaft.

Figure 7:
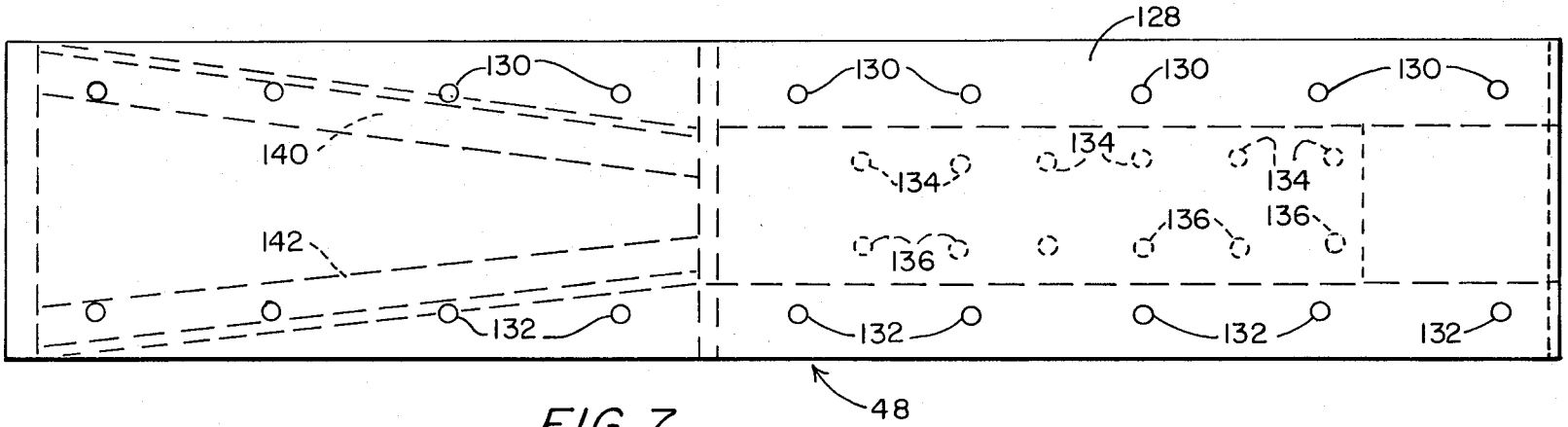
FIG. 7 is a top plan view of the upper support housing shown in FIG. 1.
Figure 8:
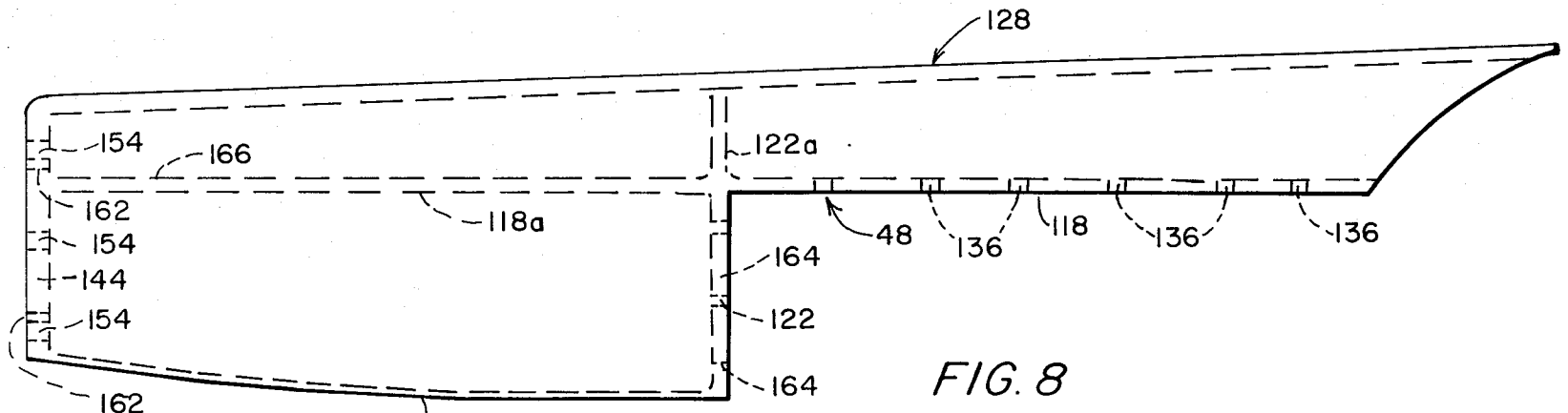
FIG. 8 is a side elevational view of the upper support housing of FIG. 7.

Referring to FIGS. 7 to 12, the construction of upper drive support housing 48 is shown. As illustrated in FIGS. 7 and 8, housing 48 includes a flat, slanted, generally rectangular upper wall 128. Wall 128 includes a pair of laterally spaced, longitudinally extending rows of bolt holes 130 and 132 which are used to secure this wall of the housing 48 to the horizontally extending offset wall 46 of hull 18 (FIG. 1). As shown in FIG. 8, vertical wall 122, which was mentioned above and is also shown in FIG. 1, includes an upper portion **122*a* which divides housing internally into front and rear sections. Similarly, rear lower wall 118, which was also mentioned previously and is also shown in FIG. 1, includes a front portion 118*a* which divides housing 48 into upper and lower sections. Wall 118 includes two rows of bolt holes 134 and 136 (see FIG. 7) which enable upper housing 48 to be bolted to lower housing 52**.

Figure 11:
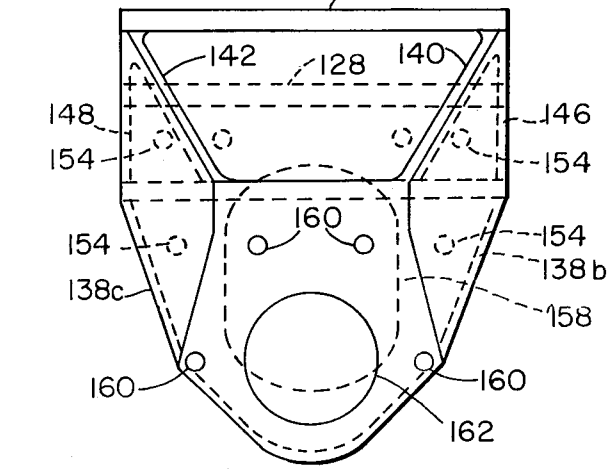
FIG. 11 is a rear end elevational view of the upper support housing of FIG. 7.
Figure 9:
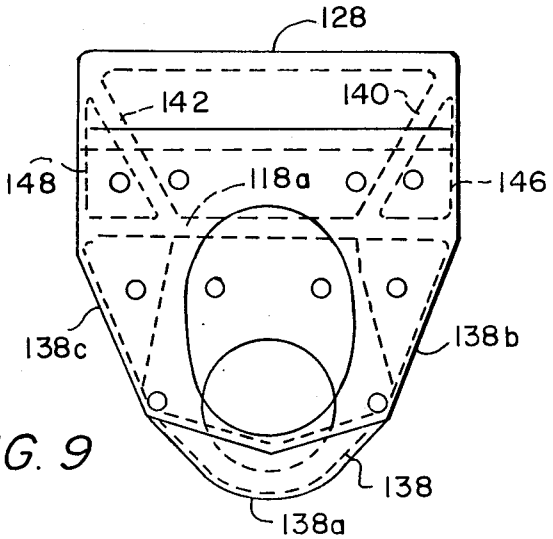
FIG. 9 is a front end elevational view of the upper support housing of FIG. 7.
Figure 10:
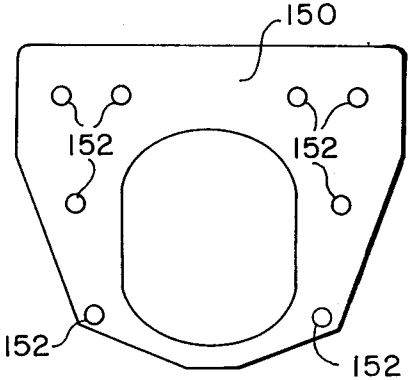
FIG. 10 is a front elevational view of an end plant shown in FIG. 9.

As is also shown in FIG. 8, front bottom wall 138 of housing 48 is gradually curved from front to rear and, as shown in FIG. 9 and 11, is also curved at the bottom portion thereof to provide streamlining of the housing and to match at the rear end thereof the lower curvature of the bore tube portion 108 of lower housing 52. More specifically, as shown in FIG. 9, wall 138 includes a curved bottom portion **138*a* and inclined side walls 138*b* and 138*c***.

As can best be seen in FIGS. 7, 9, and 11, housing 48 also includes external inclined or slanted walls 140 and 142 the spacing between which narrows down from rear to front up to wall 112 as shown in FIG. 7, and is constant thereafter to rear end of housing 48 (see FIG. 11). In addition, housing 48 includes an end wall 144 and the portion of housing 48 between end wall 144 and wall 122, **122*a* includes upper side walls 146 and 148 joined to side walls 138*b* and 138*c* respectively (see FIG. 9**).

A front end plate 150 (FIG. 10) containing bolt holes 52, is affixed (as shown in FIG. 9) by bolts (not shown) to end wall 144 Which includes corresponding bolt holes 154. Plate 150 also includes a central aperture or opening 156 through which connecting member or strut 34 extends. As illustrated, aperture 156 includes semicircular upper and lower portions joined by vertical straight sides.

Similarly, a rear end plate 158 (FIG. 12) containing bolt holes 160 is affixed, as shown in FIG. 11, to wall 122 of housing 48, end plate 158 including a circular aperture 162 therein. Thus, the connecting member or strut 34 extends into housing 48 through aperture 156, and corresponding opening 162 (FIG. 8) in end wall 144, into the space defined beneath wall 118, and the propellor shaft 36, which is connected thereto as shown in FIG. 1, exits from housing 48 through an opening 164 in wall 122 and through aperture 162. As can best be seen in FIG. 8, the front part of wall (floor) **118*a* also includes an opening 166 which accommodates the incline of connecting member 34**.

Although the present invention has been described relative to exemplary embodiments thereof, it will be understood by those skilled in the art that variations and modifications can be effected in the exemplary embodiments without departing from the scope and spirit of the invention.

I claim:

1. A propulsion system for a power boat including a hull, said propulsion system comprising: a drive motor including an output drive shaft; a fixed propellor shaft having a propellor mounted thereon; intermediate drive means for interconnecting the output drive shaft of said drive motor and said propellor shaft; means for mounting said fixed propellor shaft in a fixed, non-adjustable position wherein the shaft extends parallel to the surface of water and such that a substantial portion of the effective blade area of the propellor is out of the water while a substantial portion of the effective blade area extends into the water during normal operating conditions; said drive means including a connecting member arranged at an acute angle with respect to the axis of the propellor shaft and a universal joint disposed between one end of the connecting member and propellor shaft; and said mounting means including a propellor shaft support housing located externally of the hull, a thrust bearing assembly disposed within said housing at the end of the propellor shaft connected to the universal joint, and a further bearing assembly disposed within said housing at the other end of the propellor shaft.

2. A propulsion system as claimed in claim 1 further comprising an upper support housing, located externally of the hull, which supports said propellor shaft support housing, said universal joint being located in said upper support housing.

3. A propulsion system as claimed in claim 1 wherein said propellor shaft support housing includes a longitudinal bore therein and said thrust bearing assembly includes a pair of oppositely acting thrust bearing devices mounted within an enlarged portion of said bore, said propellor shaft further including a preloading thrust member against which one of said thrust bearing devices acts, means for holding said thrust member in place in said enlarged portion of said bore, and sealing means for providing sealing between said thrust member and the propellor shaft so as to seal off the end of the bore adjacent to said universal joint.

4. A propulsion system as claimed in claim 3 wherein said further bearing assemblY comprises a roller bearing assembly.

5. A propulsion system as claimed in claim 4 wherein said roller bearing assembly is disposed in a further enlarged portion of said bore and said propellor shaft support housing includes sealing means for sealing off the further enlarged end of the bore.

6. A propulsion system as claimed in claim 5 wherein said sealing means includes a cylindrical seal carrier and at least one peripheral sealing ring carried by the seal carrier.

7. A propulsion system as claimed in claim 6 wherein said sealing means further includes at least one lip seal disposed between said seal carrier and the propellor shaft.

8. A propulsion system as claimed in claim 1 further comprising sealing means for sealing off the other end of the housing said sealing means including a cylindrical seal carrier and at least one peripheral sealing ring carried by said seal carrier.

9. A propulsion system as claimed in claim 8 wherein said sealing means further comprises at least one lip seal disposed between said seal carrier and the propellor shaft.

10. A propulsion system as claimed in claim 1 wherein said drive means further includes a reduction gear unit; means, comprising a pair of universal joints, for interconnecting the motor drive shaft and an input of said reduction gear unit; and a further universal joint for connecting an output of the reduction gear unit to the other end of said connecting member.

11. A propulsion system as claimed in claim 1 further comprising a thrust tube surrounding said propellor shaft over a substantial portion of the length thereof and a plurality of weldments provided at spaced locations along said thrust tube which join the thrust tube to said propellor shaft and through which thrust is transmitted from the propellor shaft to the sleeve.

12. A propulsion system as claimed in claim 1 further comprising a further support housing in which said universal joint is housed and which includes a shaped bottom portion, the propellor shaft housing having a shaped bottom portion and the shapes of the bottom portions of said further support housing and said propellor shaft support housing being such that said bottom portions lie in substantially the same plane as, and effectively form an extension of, the bottom of the hull, in the region of the propellor shaft.

13. In combination, a power boat having a stepped hull providing a recessed area at the stern of the boat and a propulsion system for the boat, said propulsion system comprising: a drive motor including an output drive shaft; a fixed propellor shaft having a propellor mounted thereon; intermediate drive means for interconnecting the output device shaft of said drive motor and said propellor shaft; means for mounting said fixed propellor shaft in a fixed non-adjustable position wherein the shaft extends parallel to the surface of water and such that a substantial portion of the effective blade area of the propellor is out of the water and a substantial portion of the effective blade area of the propellor extends into the water during normal operating conditions; said drive means including a connecting member arranged at an acute angle with respect to the axis of the propellor, a connecting joint connected to said connecting member and to one end of the propellor shaft; and said mounting means including housing means located externally of the hull, and supported by the hull at the stern of the boat in said recessed area, for housing said propellor shaft and said connecting joint, a thrust bearing assembly disposed within said housing means at the end of the propulsion shaft connected to the connecting joint, and a further bearing assembly disposed within said housing means at the other end of the propellor shaft.

14. A combination as claimed in claim 13 wherein said housing means comprises a propellor shaft support housing for housing the propellor shaft and an upper support housing which is secured to the hull and which supports said propellor shaft support housing, said connecting joint being located in said upper support housing.

15. A combination as claimed in claim 14 wherein said propellor shaft support housing includes a longitudinal bore therein and said thrust bearing assembly includes a pair of oppositely acting thrust bearing devices mounted within an enlarged portion of said bore, said propellor shaft further including a preloading thrust member against which one of said thrust bearing devices acts, means for holding said thrust member in place in said enlarged portion of said bore, and sealing means for providing sealing between said thrust member and the propellor shaft so as to seal off the end of the bore adjacent to said universal joint.

16. A combination as claimed in claim 15 wherein said further bearing assembly comprises a roller bearing assembly.

17. A combination as claimed in claim 16 wherein said roller bearing assembly is disposed in a further enlarged portion of said bore and said propellor shaft support housing includes sealing means for sealing off the further enlarged end of the bore.

18. A combination as claimed in claim 13 further comprising sealing means for sealing off the end of the housing adjacent the propellor, said sealing means including a cylindrical seal carrier and at least one peripheral sealing ring carried by said seal carrier.

19. A combination as claimed in claim 13 further comprising a thrust tube surrounding said propellor shaft over a substantial portion of the length thereof and a plurality of weldments provided at spaced locations along said thrust tube which join the thrust tube to said propellor shaft and through which thrust is transmitted from the propellor shaft to the thrust tube.

20. A combination as claimed in claim 13 wherein said propellor includes a hub, and said propulsion system further comprises a thrust tube surrounding said propellor shaft over a substantial portion of the length thereof and a thrust member, disposed in engagement with said hub and said further bearing assembly, for transmitting thrust from the propellor to said thrust tube.

21. A propulsion system as claimed in claim 13 further comprising a further support housing in which said connecting joint is housed and which includes a shaped bottom portion, the propellor shaft housing having a shaped bottom portion and the shapes of the bottom portions of said further support housing and said propellor shaft support housing being such that said bottom portion lie in substantially the same plane as, and effectively form an extension of, the bottom of the hull, in the region of the propellor shaft.

22. A propulsion system for a power boat including a hull, said propulsion system comprising: a drive motor including an output drive shaft; a fixed propellor shaft having a propellor mounted thereon; intermediate drive means for interconnecting the output drive shaft of said drive motor and said propellor shaft; means for mounting said fixed propellor shaft so that the shaft extends parallel to the surface of water and such that a substantial portion of the effective blade area of the propellor is out of the water during normal operating conditions; said drive means including a connecting member arranged at an angle with respect to the propellor shaft and a universal joint disposed between one end of the connecting member and propellor shaft; and said mounting means including a propellor shaft support housing located externally of the hull, a thrust bearing assembly disposed within said housing at the end of the propellor shaft connected to the universal joint, and a further bearing assembly disposed within said housing at the other end of the propellor shaft, said propellor includes a hub and said propulsion system further comprises a thrust tube surrounding said propellor shaft over a substantial portion of the length thereof, and a thrust member, disposed in engagement with said hub and said further bearing assembly, for transmitting thrust from the propellor to said thrust tube.

* * * * *